US008931392B2

(12) United States Patent
Svensson et al.

(10) Patent No.: US 8,931,392 B2
(45) Date of Patent: Jan. 13, 2015

(54) DEVICE FOR PROTECTION AGAINST GRENADES WITH SHAPED CHARGES

(75) Inventors: Gösta Svensson, Örnsköldsvik (SE); Pekka Silvola, Örnsköldsvik (SE)

(73) Assignee: BAE Systems Hägglunds Aktiebolag, Örnsköldsvik (SE)

( * ) Notice: Subject to any disclaimer, the term of this patent is extended or adjusted under 35 U.S.C. 154(b) by 0 days.

(21) Appl. No.: 13/885,656

(22) PCT Filed: Nov. 15, 2011

(86) PCT No.: PCT/SE2011/051372

§ 371 (c)(1), (2), (4) Date: Aug. 6, 2013

(87) PCT Pub. No.: WO2012/067574

PCT Pub. Date: May 24, 2012

(65) Prior Publication Data

US 2014/0144312 A1 May 29, 2014

(30) Foreign Application Priority Data

Nov. 17, 2010 (SE) ..... 1051207

(51) Int. Cl.
*F41H 7/04* (2006.01)
*F41H 5/02* (2006.01)

(52) U.S. Cl.
CPC ..... *F41H 7/04* (2013.01); *F41H 5/026* (2013.01); *F41H 5/02* (2013.01)
USPC ..... 89/36.08; 89/918

(58) Field of Classification Search
CPC ..... F41A 5/026
USPC ..... 89/36.08, 36.01, 36.02, 36.13, 918; 114/240 D, 240 R, 14, 9, 10
See application file for complete search history.

(56) References Cited

U.S. PATENT DOCUMENTS 3,137,205 A 6/1964 Berge et al.
6,311,605 B1 * 11/2001 Kellner et al. ..... 89/36.02

(Continued)

FOREIGN PATENT DOCUMENTS

EP 2020585 A2 2/2009
WO 2009/064263 A2 5/2009

OTHER PUBLICATIONS

International Search Report and Written Opinion received for PCT Patent Application No. PCT/SE2011/051372, mailed on Feb. 20, 2012, 13 pages.

*Primary Examiner* — Reginald Tillman, Jr.
(74) *Attorney, Agent, or Firm* — Morrison & Foerster LLP

(57) ABSTRACT

The present invention relates to a protection device (10) for protection against so called RSV-grenades comprising a grid configuration (20) with at least one profile element arranged to affect the electric detonation release arrangement (52) of such a grenade (50) by means of short-circuiting, characterized in that said at least one profile element (30; 30*a;* 30*b;* 30*c;* 30*d;* 30*e;* 30*f*) has a cross section being tapering in the principal incoming direction of the grenade. The invention also relates to a motor vehicle.

10 Claims, 3 Drawing Sheets

(56) References Cited

U.S. PATENT DOCUMENTS

| | | | | |
|---|---|---|---|---|
| 8,701,541 | B2 * | 4/2014 | Radstake et al. | 89/36.02 |
| 2008/0257141 | A1 * | 10/2008 | Medwell et al. | 89/36.02 |
| 2010/0288114 | A1 * | 11/2010 | Soukos | 89/36.02 |
| 2011/0067561 | A1 * | 3/2011 | Joynt | 89/36.02 |
| 2011/0113952 | A1 * | 5/2011 | Rosenwasser et al. | 89/36.02 |
| 2011/0232472 | A1 * | 9/2011 | Kellner et al. | 89/36.08 |

* cited by examiner

DEVICE FOR PROTECTION AGAINST GRENADES WITH SHAPED CHARGES

CROSS REFERENCE TO RELATED APPLICATIONS

This application is a U.S. National Phase patent application of PCT/SE2011/051372, filed Nov. 15, 2011, which claims priority to Swedish Patent Application No. 1051207-7, filed Nov. 17, 2010, each of which is hereby incorporated by reference in the present disclosure in its entirety.

TECHNICAL FIELD

The invention relates to a protection device according to the preamble of claim 1. The invention also relates to a motor vehicle.

BACKGROUND ART

Light and heavy armoured military vehicles, non armoured military vehicles and civilian vehicles and other objects being in areas subjected to warfare risk being exposed to armoured bulkhead by means of grenades with directional explosive strength, so called RSV-grenades or RPGs (Rocket Propelled Grenades). These grenades consequently constitute a serious threat to the vehicle and its crew.

There are different ways of protecting oneself against RSV-grenades. One way of protecting oneself against RSV-grenades is to provide such vehicles with protection devices comprising a grid configuration with profile element arranged to affect the electric detonation release arrangement of such a grenade by means of short-circuiting. Hereby a weakness of the construction of the RSV-grenade is utilized, wherein initiation of the directed explosive strength may be prevented by compressing the nose cone.

In order to ensure that the directed explosive strength of the RSV-grenade is prevented the profile elements according to a variant are relatively deep such that the nose cone of the grenade manages to be compressed during the contact with the profile elements. As the profile elements are relatively deep the performance of the protections is heavily reduced the higher the angle of impact of the projectile hitting the protections.

OBJECTS OF THE INVENTION

An object of the present invention is to provide a protection device for protection against incoming RSV-grenades which reduces the risk for initiation of the directed explosive power of such grenades and consequently improve protective performance.

SUMMARY OF THE INVENTION

These and other objects, apparent from the following description, are achieved by a protection device and a motor vehicle which are of the type stated by way of introduction and which in addition exhibits the features recited in the characterising clause of the appended claims 1 and 10. Preferred embodiments of the protection device are defined in appended dependent claims 2-9.

According to the invention the objects are achieved by a protection device for protection against so called RSV-grenades comprising a grid configuration with at least one profile element arranged to affect the electric detonation release arrangement of such a grenade by means of short-circuiting, wherein said at least one profile element has a cross section being tapering in the principal incoming direction of the grenade. Hereby the protection performance is improved in that initiation of the directed explosive power of the RSV-grenades is reduced even at higher angles of impact.

According to an embodiment of said protection device said grid configuration comprises at least two essentially mutually parallel running profile elements. Hereby the ability to prevent detonation of the RSV-grenades is improved in that the probability of preventing detonation of the RSV-grenades coming in contact with a profile element is increased. Further it is facilitated that the nose cone of the grenade is squeezed between the profile elements which increases the probability for short-circuiting of the detonation release arrangement.

According to an embodiment of said protection device said at least one profile element is arranged to run essentially horizontally. Hereby the ability to prevent detonation of the RSV-grenades is improved in that the impact of the grenades to a great extent occurs in a direction lying within the horizontal plane and with a certain angle above the horizontal plane, while the angle relative to the horizontal plane varies to a greater extent.

According to an embodiment of said protection device the cross section of said at least one profile element has a corner portion projecting towards said principal incoming direction, the corner portion having an acute angle. Hereby the probability of the detonation release arrangement of the grenade being short-circuited is increased in that the projecting corner portion catches hold of the side body of the grenade.

According to an embodiment of said protection device the acute angle of said projecting corner portion formed by means of a recess facing said principal incoming direction. Hereby is facilitated to obtain projecting corners on both corner portions of the side of the cross section of the profile element facing the grenade which results in increased probability for the detonation release arrangement of the grenade to be short-circuited in that a projecting corner portion catches hold of the side body of the grenade independently of the grenade coming obliquely from below or obliquely from above.

According to an embodiment of said protection device said recess has an essentially arc-shaped cross section. An arc-shaped recess is easy to obtain and results in double projecting pointed corners.

According to an embodiment of said protection device the cross section of said at least one profile element comprises an essentially horizontally running side and towards that with an angle running side. Hereby protection performance is improved in that initiation of the directed explosive power of the RSV-grenades is reduced at higher angles of impact, i.e. the front of grenades coming in obliquely from above will not impact with the upper side of the profile element but in the side such that the detonation release arrangement is short-circuited.

According to an embodiment of said protection device the cross section of said at least one profile element comprises two opposite sides, each forming an angle to the horizontal plane. Hereby protection performance is improved in that initiation of the directed explosive power of the RSV-grenades is reduced at both higher and lower angles of impact, i.e. the front of grenades incoming obliquely from above will not impact with the upper side of the profile element and the front of grenades incoming obliquely from below will not impact with the underside of the profile element but in the side such the detonation release arrangement is short-circuited.

According to an embodiment of said protection device said adjacent profile elements of said grid configuration forms a minimum space which is smaller than the greatest thickness of a grenade at said electric detonation release arrangement. Hereby the body of the incoming RSV-grenade is squeezed such that the detonation release arrangement is short-circuited, wherein detonation is efficiently prevented.

BRIEF DESCRIPTION OF THE DRAWINGS

A better understanding of the present invention will be had upon the reference to the following detailed description when read in conjunction with the accompanying drawings, wherein like reference characters refer to like parts throughout the several views, and in which.

DETAILED DESCRIPTION

Figure 1:
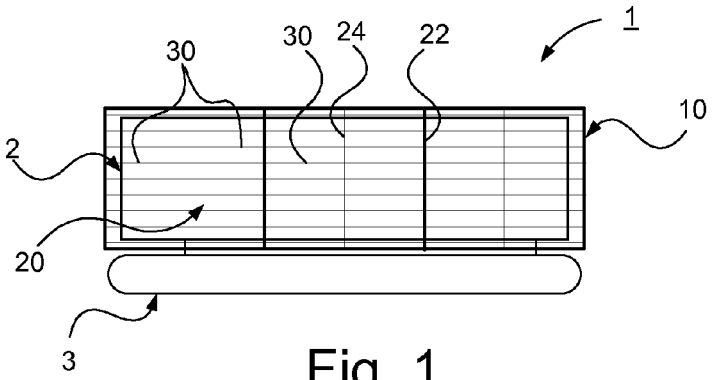
FIG. 1 schematically illustrates a side view of a motor vehicle.

FIG. 1 schematically illustrates a vehicle 1 according to an embodiment of the present invention. The exemplified vehicle 1 is constituted by a heavy vehicle in the form of an armoured tracked vehicle. The vehicle may also be constituted by a wheeled vehicle. The vehicle may be constituted by an articulated vehicle. The vehicle may be constituted by a heavy armoured military vehicle, a light armoured military vehicle, an non-armoured military vehicle or a civilian vehicle.

The vehicle according to FIG. 1 has a vehicle body 2 and tracks 3 for impelling of the vehicle 1. The vehicle 1 comprises a protection device 10 according to the present invention.

The protection device 10 for protection against so called RSV-grenades comprises a grid configuration 20 with a set of profile elements 30 running essentially mutually parallel, at a distance from each other and in the longitudinal direction of the vehicle. Said profile elements are also according to a variant arranged to run crosswise to the longitudinal direction of the vehicle, not shown.

Said profile elements 30 are arranged to affect the electric detonation release arrangement of an RSV-grenade by means of short-circuiting, i.e. preventing initiation of the directed explosive power of impacting RSV-grenades. Said profile elements 30 are arranged at a distance from the vehicle such that the detonation release arrangement of the RSV-grenade manages to be short-circuited before the grenade impacts with the vehicle.

The grid configuration 20 further comprises essentially mutually parallel and vertically running elements 22, 24, wherein each profile element 30 is arranged between two such vertically running elements 22, 24. The vertically running elements comprise support elements 22 via which the grid configuration is arranged to be attached to the vehicle via not shown fastening devices. The vertically running elements 22, 24 further comprise intermediate elements 24 arranged between the support elements 22 for connecting and supporting profile elements 30 there between.

Figure 2:
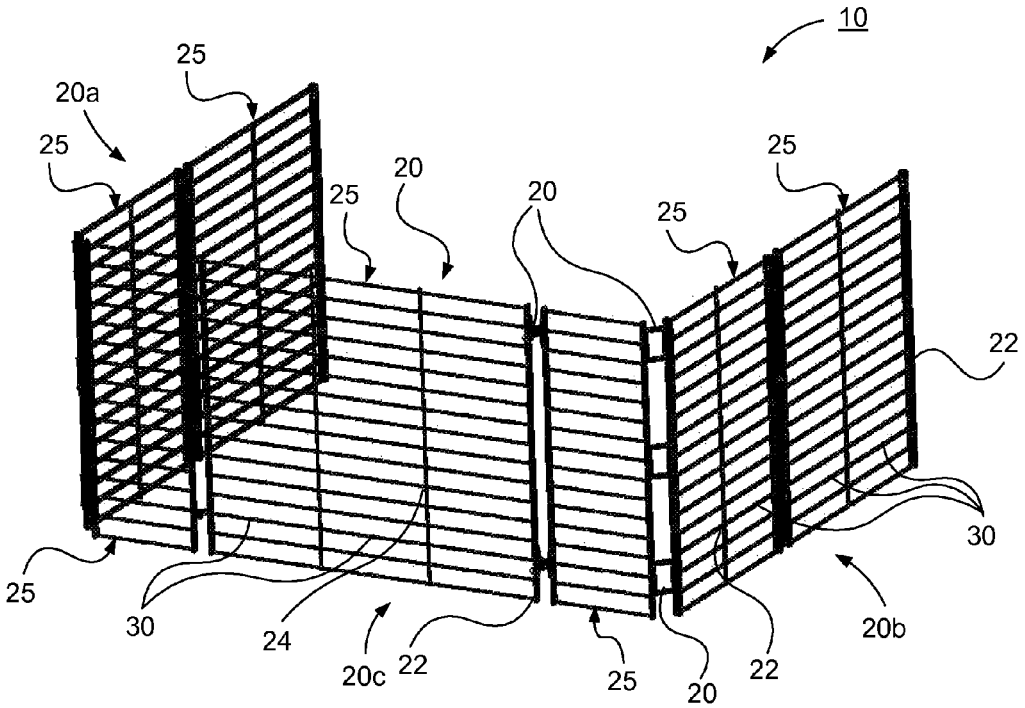
FIG. 2 schematically illustrates a perspective view of a protection device according to an embodiment of the present invention.

FIG. 2 schematically illustrates a perspective view of a protection device 10 according to an embodiment of the present invention in accordance with the protection device 10 in FIG. 1. The protection device 10 is intended to protect vehicles or other object from RSV-grenades. The protection device 10 comprises a grid configuration 20.

The grid configuration 20 comprises in accordance with the grid configuration 20 in FIG. 1 a set of profile elements 30 running essentially mutually parallel and in the longitudinal direction of the vehicle. The grid configuration 20 further comprises in accordance with the grid configuration in FIG. 1 vertically running elements 22, 24 comprising support elements 22 for supporting and attaching the grid configuration 20 to an object such as a vehicle, and where applicable intermediate elements 24 connecting and supporting the profile elements 30 being arranged between the support elements 22.

Figure 4:
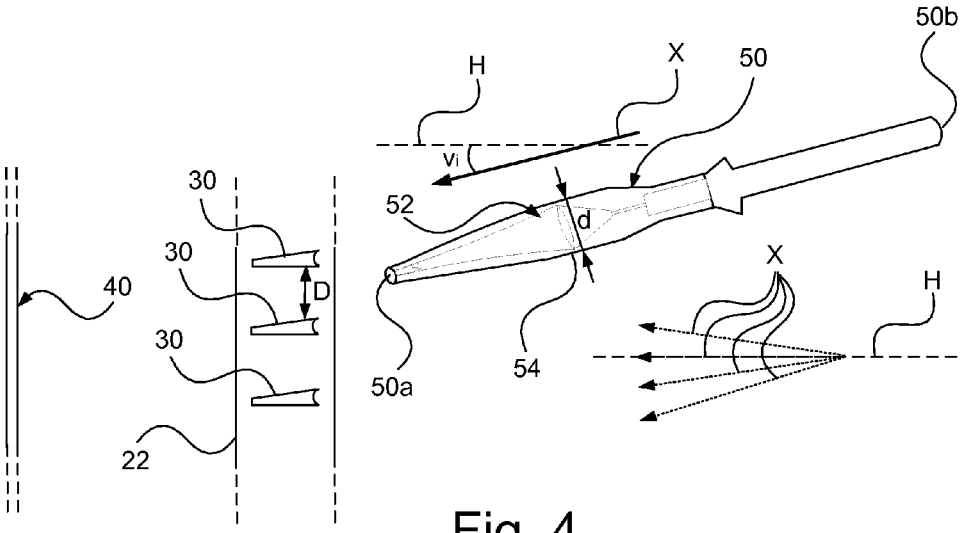
FIG. 4 schematically illustrates a part of an object with a protection device according to the present invention with an incoming RSV-grenade, and FIG. 5*a-f* schematically illustrates cross-sectional views of profile elements according to different embodiments of the present invention.

Adjacent profile elements 30 of said grid configuration 20 forms a minimum space which is less than the greatest thickness of a grenade at said electric detonation release arrangement. This is illustrated in FIG. 4.

Two adjacent vertically and mutually parallel running support elements 22 and there between arranged horizontally running profile elements 30 and where applicable intermediate vertically running elements 24 forms panel elements 25. The grid configuration 20 comprises a set of vertical panel elements 25 linked together via fastening elements 26.

According to this variant the panel elements 25 linked together forms a U-shaped cage-like grid configuration 20 with a right side 20*a*, a left side 20*b* and front side 20*c*. According to a variant the protection device 10 is configured to be arranged on a front vehicle unit of a not shown tracked vehicle with a front vehicle unit and a rear vehicle unit linked together via a steering member. According to a variant one or more panel elements are rotatably arranged for access into the vehicle.

According to an embodiment said profile element 30 according to the present invention is made of metal. According to an embodiment said profile elements 30 are made of aluminium, which results in a light construction. According to a variant the grid configuration is made of metal. According to an embodiment the grid configuration is made of aluminium, which results in a light construction being easy to handle.

Figure 3A:
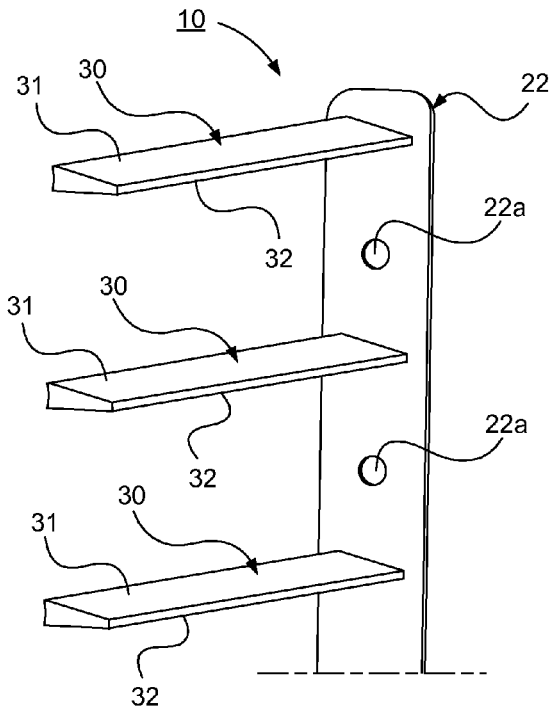
FIG. 3*a* schematically illustrates a perspective view of a part of a protection device according to an embodiment of the present invention.
Figure 3B:
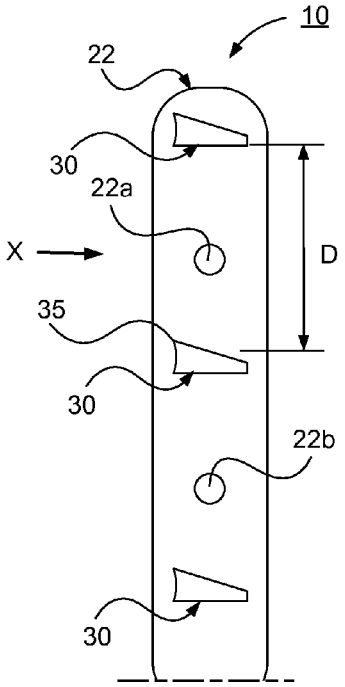
FIG. 3*b* schematically illustrates the part of the protection device in FIG. 3*a* viewed in its longitudinal direction.

FIG. 3*a* schematically illustrates a perspective view of a part of a protection device 10 according to an embodiment of the present invention, FIG. 3*b* the part of the protection device 10 in FIG. 3*a* viewed in its longitudinal direction and FIG. 4 a part of an object 40, e.g. a vehicle 40, with a protection device 10 according to FIG. 3*a-b* with an incoming RSV-grenade 50 with a detonation release arrangement 52.

The protection device 10 comprises essentially mutually parallel running horizontal profile elements 30 and an essentially vertically running support element 22 at which the profile elements 30 are arranged. The support elements 22 comprises holes 22*a*, 22*b* for applying fastening elements for attaching the support elements 22 to each other for forming of grid configuration, and for attaching the protection device 10 to a vehicle 40 or the corresponding.

The profile elements 30 are arranged at a distance from each other such that adjacent profile elements 30 of said protection device 10 forms a minimum space D which is less than the largest thickness/diameter d of a grenade at said electric detonation release arrangement.

Each profile element 30 has a cross section being tapering in the principal incoming direction X of the grenade. The cross section of the profile elements comprises an essentially horizontally running underside 32 and an upper side 31 running with an angle towards that.

As the RSV-grenade 50 approaches in the direction towards the profile elements 30 initiation of the directed explosive power will be prevented in that the nose cone is compressed at said electric detonation release arrangement 52 such that it is short-circuited.

The RSV-grenade 50 has a front side 50*a* and a rear side 50*b*. The RSV-grenade 50 is arranged to contain said detonation release arrangement 52 in a body with an area 54 with a greatest thickness d, the detonation release arrangement 52 being short-circuited when the body is compressed thereby.

The RSV-grenade 50 is configured such that when the front side 50*a* impacts with an object, the detonation release arrangement 52 is activated electrically such that the RSV-grenade 50 detonates, if the detonation release arrangement 52 has not been short-circuited.

The RSV-grenade 50 illustrated in FIG. 4 approaches with an angle v, which is larger than the horizontal plane H, i.e. obliquely from above. As the profile elements 30 has a cross section being tapering in the principal incoming direction of the grenade, the upper side of the profile element 30 having an angle to the horizontally running underside, the front side of the RSV-grenade will not impact with the upper side of the profile element 30 but be squeezed between the profile elements 30 such that the detonation release arrangement is short-circuited, preventing detonation.

The cross section of each profile element 30 has a corner portion 35 projecting towards said principal incoming direction, the corner portion having an acute angle. The acute angle of said corner portion is formed by means of a recess with an essentially arc-shaped cross section facing the principal incoming direction X. The profile element 30 is shown in more detail in FIG. 5*a*. By means of the projecting corner portion 35 the ability to compress the nose cone of the RSV-grenade 50 is improved in that the pointed corner catches hold of the grenade 50 and thus affects the detonation release arrangement by means of short-circuiting.

FIG. 5*a-f* schematically illustrates cross sectional views of the profile element 30*a*, 30*b*, 30*c*, 30*d*, 30*e*, 30*f* according to different embodiments of the present invention. The profile elements 30*a-f* according to the embodiments has a cross section being tapering in the principal incoming direction of the grenade. Each profile element 30*a-f* has en upper side 31*a-f*, an underside 32*a-f* and an inner side 33*a-f* intended to face the object/vehicle to be protected and an opposite outer side 34*a-f* being intended to face away from said object/vehicle, i.e. to face the incoming direction of the RSV-grenade.

Consequently the height H1 of the inner side 33*a-f* of the profile element is lower than the height H2 of the outer side 34*a-f*. Further the cross section of the profile element is elongated such that the width W, i.e. the distance between the outer side 34*a-f* and the inner side 33*a-f*, is greater than the height H2 of the outer side 34*a-f*. This is illustrated in the embodiment in FIG. 5*a* but applies for all embodiments according to the present invention. The height H2 is substantially smaller than the distance D such that the probability of the RSV-grenade hitting the outer side of a profile element is minimized.

Further the outer side 34*a-f* of the cross section of the respective profile element has two corner portions where at least one corner portion has an acute angle v.

In FIG. 5*a-d* the underside of the cross section of the profile element has projecting corner portions with acute angle v being formed by means of a recess with an essentially arc-shaped cross section facing the principal incoming direction.

Figure 5A:
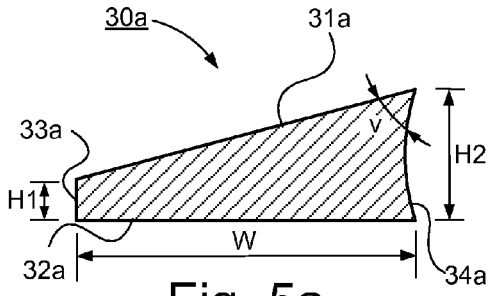

FIG. 5*a* shows a cross section of a profile element 30*a* in accordance with the profile element in FIG. 3*a-b* and FIG. 3. The underside 32*a* of the cross section of the profile element is essentially horizontally running and the upper side 31*a* running towards that forms an angle to the horizontal plane. The upper side 31*a* consequently forms a bevel. The outer side 34*a* of the cross section of the profile element has a recess with an arc-shaped cross section.

Figure 5B:
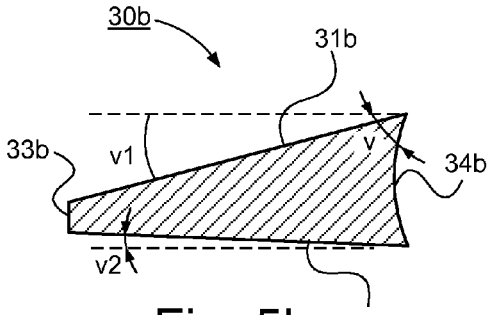

FIG. 5*b* shows a cross section of a profile element 30*b* according to an embodiment of the present invention. The upper side 31*b* of the cross section of the profile element forms an angle v1 to the horizontal plane and the opposite underside 32*b* forms an angle v2 to the horizontal plane. The upper side 31 runs with a downward slope in the principal incoming direction of the RSV-grenade and the underside runs with an upward slope in the principal incoming direction of the RSV-grenade. Hereby is facilitated to prevent detonation even when the RSV-grenade approaches with an angle being less than the horizontal plane, i.e. obliquely from below, as the front side of the RSV-grenade will not impact with the underside 32*b* of the profile element 30*b* but be squeezed between the profile elements such that the detonation release arrangement is short-circuited.

The angle v1 between the horizontal plane and the upper side is according to this embodiment greater than the angle v2 between the horizontal plane and the underside. Any suitable angle between horizontal plane and upper side and horizontal plane and underside is however conceivable, which angles among others depend on application, position of vehicle/object, terrain etc.

Figure 5C:
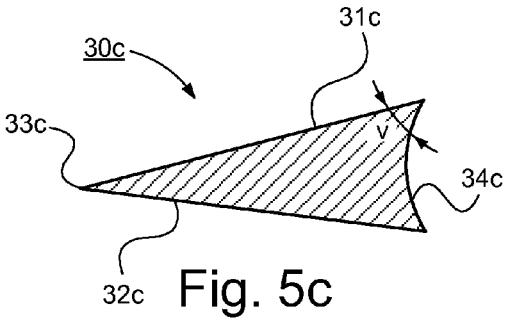

FIG. 5*c* shows a cross section of a profile element 30*c* according to an embodiment of the present invention. The embodiment according to FIG. 5*c* differs from the embodiment according to FIG. 5*b* in that the inner side 33*c* is essentially pointed. Further, the angle between the horizontal plane and the upper side 31*c* and the angle between the horizontal plane and the underside 32*c* is essentially the same.

Figure 5D:
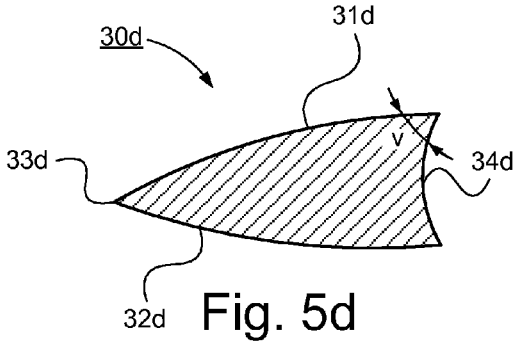

FIG. 5*d* shows a cross section of a profile element 30*d* according to an embodiment of the present invention. The embodiment according to FIG. 5*d* differs from the embodiment according to FIG. 5*c* in that the upper side 31*d* and the underside 32*d* are curved or arc-shaped. According to an alternative variant the upper side is arc-shaped and the underside flat. According to yet an alternative variant the upper side is flat and the underside is arc-shaped.

Figure 5E:
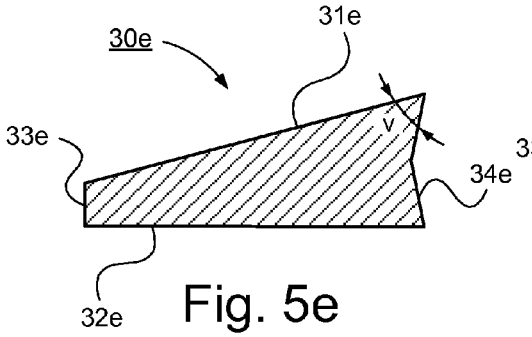

FIG. 5*e* shows a cross section of a profile element 30*e* according to an embodiment of the present invention. The embodiment according to FIG. 5*e* differs from the embodiment according to FIG. 5*a* in that the outer side 34*e* of the cross section of the profile element has a recess with an angled cross section, wherein the respective corner at the outside of the cross section of the profile element projects and forms a acute angle v.

Figure 5F:
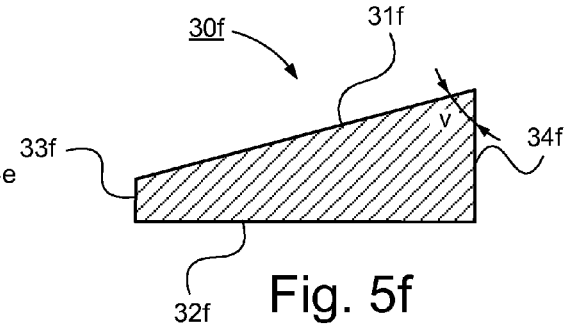

FIG. 5*f* shows a cross section of a profile element 30*f* according to an embodiment of the present invention. The embodiment according to FIG. 5*e* differs from the embodiment according to FIG. 5*a* in that the outer side of the cross section of the profile element 30*f* is essentially vertical. Hereby only the upper corner at the outer side of the profile element forms an acute angle v.

According to an embodiment said profile elements 30*a-f* according to the present invention are made of metal. According to an embodiment said profile elements 30*a-f* are made of aluminium, which results in a light and rigid construction. Alternatively said profile elements are made of composite, which also results in a light and rigid construction. According to yet an alternative variant said profile elements are made of steel which results in a rigid construction.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

The invention claimed is:

1. A protection device for protecting an object against a rocket propelled grenade comprising a grid configuration comprising at least two essentially mutually parallel running profile elements arranged to affect the electric detonation release arrangement of the grenade by short-circuiting, wherein said profile elements each have a cross section being tapering in a principal incoming direction of the grenade to have a tapering end, and wherein the cross section of the profile element has a corner portion facing the principal incoming direction, the corner portion has an acute angle, and the corner portion is different from the tapering end, and wherein the tapering end is an end facing the protected object and the corner portion is at an end opposite from the tapering end.

2. A protection device according to claim 1, wherein said profile elements are each arranged to run essentially horizontally.

3. A protection device according to claim 1, wherein the corner portion projects towards said principal incoming direction.

4. A protection device according to claim 3, wherein the acute angle of said projecting corner portion is created by forming a recess facing said principal incoming direction.

5. A protection device according to claim 4, wherein said recess has an essentially arc-shaped cross section.

6. A protection device according to claim 1, wherein the cross section of said profile elements comprises an essentially horizontally running side and a side running with an angle towards that.

7. A protection device according to claim 1, wherein the cross section of said profile elements comprises two opposite sides, each forming an angle to the horizontal plane.

8. A protection device according to claim 1, wherein adjacent profile elements of said grid configuration forms a minimum space which is smaller than the greatest thickness of the grenade at said electric detonation release arrangement.

9. A vehicle comprising a protection device according to claim 1.

10. A protection device according to claim 1, wherein the tapering end is configured to face an object to be protected by the protection device.

* * * * *